US011047561B1

(12) United States Patent
Chen et al.

(10) Patent No.: US 11,047,561 B1
(45) Date of Patent: Jun. 29, 2021

(54) HEAT SINK STRUCTURE AND FLEXIBLE LIGHT-EMITTING DEVICE HAVING HEAT SINK STRUCTURE

(71) Applicant: EXCELLENCE OPTOELECTRONICS, INC., Miaoli County (TW)

(72) Inventors: Pin-Chu Chen, Miaoli County (TW); Yi-Jing Huo, Miaoli County (TW); Sheng-Hua Yang, Miaoli County (TW)

(73) Assignee: Excellence Optoelectronics Inc., Hsinchu Science Park (TW)

( * ) Notice: Subject to any disclaimer, the term of this patent is extended or adjusted under 35 U.S.C. 154(b) by 0 days.

(21) Appl. No.: 15/930,317

(22) Filed: May 12, 2020

(30) Foreign Application Priority Data

Dec. 31, 2019 (TW) ..... 108148666
Dec. 31, 2019 (TW) ..... 108217502

(51) Int. Cl.
*F21V 29/73* (2015.01)
*F21V 29/76* (2015.01)
*F21Y 115/10* (2016.01)

(52) U.S. Cl.
CPC ..... *F21V 29/73* (2015.01); *F21V 29/763* (2015.01); *F21Y 2115/10* (2016.08)

(58) Field of Classification Search
None
See application file for complete search history.

(56) References Cited

U.S. PATENT DOCUMENTS 4,707,766 A 11/1987 Bertozzi et al.
2012/0169202 A1 7/2012 Marquis et al.

FOREIGN PATENT DOCUMENTS

| | | | | |
|---|---|---|---|---|
| CN | 101619843 A | | 1/2010 | |
| IT | UB20155335 A1 | * | 4/2017 | ..... F21S 4/22 |
| IT | UB20155335 A1 | | 4/2017 | |
| KR | 100936942 B1 | * | 1/2010 | |
| KR | 100936942 B1 | | 1/2010 | |
| TW | 200910547 A | | 3/2009 | |
| TW | M392534 U | | 11/2010 | |

OTHER PUBLICATIONS

Search Report Issued by a Foreign Patent Office 20020215.8-1015.
Office Action issued by Foreign Patent Office dated Jan. 20, 2021 for corresponding Application 108148666.

* cited by examiner

*Primary Examiner* — Britt D Hanley
(74) *Attorney, Agent, or Firm* — Rosenberg, Klein & Lee

(57) ABSTRACT

The present invention relates to a heat sink structure and a flexible light-emitting device with heat sink structures. The heat sink structure according to the present invention dissipates heat through a heat sink part. A hooking part on one end of the heat sink structure hooks a fixing part of another heat sink structure for forming flexible and bendable heat sink structures. Bending the heat sink structures gives a first nonlinear structure. The flexible light-emitting device can be disposed on the heat sink structures. The heat generated by the flexible light-emitting device can be removed by the heat sink structures. The heat sink structures can adapt to lamps with various designs. Then the design freedom and reliability of lamps can be improved.

19 Claims, 6 Drawing Sheets

HEAT SINK STRUCTURE AND FLEXIBLE LIGHT-EMITTING DEVICE HAVING HEAT SINK STRUCTURE

FIELD OF THE INVENTION

The present invention relates generally to a structure and a device, and particularly to a flexible light-emitting device having heat sink structure.

BACKGROUND OF THE INVENTION

The applications of linear light source have evolved from low-power lamps to high-power ones gradually. The increase in the power of LED light sources has included requirements in temperature control and heat dissipation.

The heat sink according to the prior art is adopted for preventing damages of the components in electronic products due to high temperatures. Thereby, the materials for heat sinks are mainly metals with superior thermal conductivity, light weight, and ease of processing, such as aluminum, copper, or silver. Since silver is a valuable noble metal, it is seldom adopted in heat sink applications. Most heat sinks are mainly aluminum alloys with high thermal conductivity. The cost of aluminum alloys is affordable. The manufacturing processes for heat sinks include extrusion, stamping, and die-casting. The heat sink technology is mostly applied to linearly extended modules and provides an effective heat dissipating method for lamps.

In addition, the lighting products according to the prior art are mainly dot or plane light sources. The major high-power dot or plane hot regions should correspond to heat dissipating mechanisms for conducting heat to heat sinks rapidly. Thereby, the lighting products according to the prior art mostly adopt traditional heat sinks. Lamps with dot or plane light sources can generate extremely high brightness. Unfortunately, owing to the disposition of heat sinks, the flexibility in lamp design is restricted, since the appearance will be limited by heat sinks.

In addition to the lighting products according to the prior art, there are decorative light bars formed by soft materials and without heat sink. Compared with the lighting products according to the prior art, decorative light bars have higher design flexibility. Unfortunately, the power and brightness cannot meet the regulation for lighting or car lamp applications. The feature of linear light sources is modulization while extending linearly. The light sources can be repeated to achieve the desired shape and length.

Moreover, to extend the lifetime of high-power lamps with excellent lighting performance, high-power lamps require heat sinks. The heat generated by LEDs can be guided to the ambient outside the lamps by heat sinks. Thereby, most LED lamps according to the prior art adopt heat sinks for heat guidance.

Nonetheless, to apply heat sinks to light bars or lamps with special shapes, such as curve or wave shapes, if the heat sinks are designed integrally with the special shapes, the total length and width of the heat sinks might be close to the maximum size of the light bars. Then customized molds and special manufacturing machines are required, leading to higher manufacturing costs. On the contrary, if the heat sinks are fabricated in composite forms, the size or angles of the heat sinks should be modified according to special shape designs. Consequently, the production advantage of modular reuse will be lost.

Accordingly, the present invention provides a heat sink structure applicable to light-source modules or linear light-source modules with special shapes. The heat sink is manufactured by lightweight and low-cost aluminum alloys. By connecting multiple heat sink structures to form a nonlinear structure, the formed heat sink structure can be applied to light-source modules with nonlinear shapes.

According to the above description, the present invention provides a heat sink structure and a flexible light-emitting device with heat sink structure. The heat sink structure according to the present invention can use the hooking part to hook to the fixing part of another heat sink structure to form a linear heat sink. Alternatively, heat sink structures with different heights can be combined to form a nonlinear structure applied to nonlinear light-emitting modules. The combination of multiple heat sink structures enables flexibility of the module of the heat sink structure for adapting to curved lamp shapes with variations. Thereby, the development costs can be reduced and various lamp designs can be improved.

SUMMARY

An objective of the present invention is to provide a heat sink structure, which requires no multiple processing and assembly for reducing processes and development costs. In addition, it can match the width of light-emitting devices for designing special modules.

Another objective of the present invention is to provide a flexible light-emitting device with heat sink structure, which can dissipate heat by disposing a flexible light-source module on the heat sink structure. Multiple heat sink structures are mutually fixed to form flexible heat sink structures. By using the flexibility of the heat sink module, the shape of the light-source modules can be highly flexible.

Still another objective of the present invention is to provide a flexible light-emitting device with heat sink structure, which can dissipate heat by disposing a single light-source module on the heat sink structure. By using the heat sink structure, the shape of the light-source modules can be highly flexible. Besides, the electrical connection points of the light-source module are protected to avoid breakage owing to the flexible movement of the light-source module.

To achieve one objective as described above, the present invention provides a heat sink structure, which comprises a body, a hooking part, and a fixing part. A heat sink part is disposed below the body. The hooking part includes a first bending part connected to one end of the body. The other end of the first bending part extends downwards to form one end of a first extending part. The other end of the first extending part extends inwards and then upwards to form a hook. The fixing part is disposed corresponding to the hooking part. The other end of the body extends downwards to form one end of a second bending part of the fixing part. The other end of the second bending part extends downwards to form a second extending part. The second bending part includes a hole.

According to an embodiment of the present invention, the heat sink part further includes an extension and bending mechanism. A first bending part of the extension and bending mechanism extends downwards to a second bending part. The second bending part extends horizontally to a third bending part. The third bending part extends upwards.

According to an embodiment of the present invention, the heat sink part includes a plurality of fins.

According to an embodiment of the present invention, the hole is disposed corresponding to the width of the hooking part.

To achieve another objective as described above, the present invention provides a flexible light-emitting device with heat sink structure, which comprises a first heat sink structure, a second heat sink structure, and a flexible light-emitting device. The first heat sink structure comprises a first body, a first hooking part, and a first fixing part. A first heat sink part is disposed below the first body. The first fixing part is disposed corresponding to the first hooking part. The first fixing part includes a first hole. A second heat sink structure comprises a second body, a second hooking part, and a second fixing part. A second heat sink part is disposed below the second body. The second fixing part is disposed corresponding to the second hooking part. The second fixing part includes a second hole. The second hooking part hooks into the first hole such that the first heat sink structure hooks the second heat sink structure. The first heat sink structure and the second heat sink structure form a first nonlinear structure. The flexible light-emitting device is disposed on the first body and the second body.

According to an embodiment of the present invention, the first hole is disposed corresponding to the width of the first hooking part; the second hole is disposed corresponding to the width of the second hooking part.

According to an embodiment of the present invention, the height of the second heat sink structure is greater than the height of the first heat sink structure.

According to an embodiment of the present invention, the first heat sink structure and the second heat sink structure form a second nonlinear structure.

According to an embodiment of the present invention, the flexible light-emitting device includes an insulation layer, a flexible printed circuit layer 264, one or more LED light source, and a flexible optical structure. The flexible printed circuit layer is disposed on the insulation layer. The one or more LED light source is disposed on the flexible printed circuit layer. The flexible optical structure is disposed on the one or more LED light source.

According to an embodiment of the present invention, the flexible light-emitting device further comprises a fixing adhesive tape disposed below the insulation layer.

According to an embodiment of the present invention, the first heat sink part further includes a first extension and bending mechanism. A first bending part of the first extension and bending mechanism extends downwards to a second bending part. The second bending part extends horizontally to a third bending part. The third bending part extends upwards.

According to an embodiment of the present invention, the second heat sink part further includes a second extension and bending mechanism. A fourth bending part of the second extension and bending mechanism extends downwards to a fifth bending part. The fifth bending part extends horizontally to a sixth bending part. The sixth bending part extends upwards.

To achieve another objective as described above, the present invention provides a flexible light-emitting device with heat sink structure, which comprises a first heat sink structure, a second heat sink structure, and two flexible light-emitting devices. The first heat sink structure comprises a first body, a first hooking part, and a first fixing part. A first heat sink part is disposed below the first body. The first fixing part is disposed corresponding to the first hooking part. The first fixing part includes a first hole disposed corresponding to the width of the first hooking part. A second heat sink structure comprises a second body, a second hooking part, and a second fixing part. A second heat sink part is disposed below the second body. The second fixing part is disposed corresponding to the second hooking part. The second fixing part includes a second hole. The second hooking part hooks into the first hole such that the first heat sink structure hooks the second heat sink structure. The first heat sink structure and the second heat sink structure form a first nonlinear structure. The two flexible light-emitting devices are disposed on the first body and the second body, respectively.

According to an embodiment of the present invention, the first hole is disposed corresponding to the width of the first hooking part; the second hole is disposed corresponding to the width of the second hooking part.

According to an embodiment of the present invention, the height of the second heat sink structure is greater than the height of the first heat sink structure.

According to an embodiment of the present invention, the first heat sink structure and the second heat sink structure form a second nonlinear structure.

According to an embodiment of the present invention, the flexible light-emitting device includes an insulation layer, a flexible printed circuit layer 264, one or more LED light source, and a flexible optical structure. The flexible printed circuit layer is disposed on the insulation layer. The one or more LED light source is disposed on the flexible printed circuit layer. The flexible optical structure is disposed on the one or more LED light source.

According to an embodiment of the present invention, the flexible light-emitting device further comprises a fixing adhesive tape disposed below the insulation layer.

According to an embodiment of the present invention, the first heat sink part further includes a first extension and bending mechanism. A first bending part of the first extension and bending mechanism extends downwards to a second bending part. The second bending part extends horizontally to a third bending part. The third bending part extends upwards.

According to an embodiment of the present invention, the second heat sink part further includes a second extension and bending mechanism. A fourth bending part of the second extension and bending mechanism extends downwards to a fifth bending part. The fifth bending part extends horizontally to a sixth bending part. The sixth bending part extends upwards.

According to an embodiment of the present invention, the heat sink part includes a plurality of fins.

DETAILED DESCRIPTION

In order to make the structure and characteristics as well as the effectiveness of the present invention to be further understood and recognized, the detailed description of the present invention is provided as follows along with embodiments and accompanying figures.

The heat sink structures according to the prior art are all rigid heat sink structures. In other words, they are mainly linear structures. If the light-emitting device is designed curved or flexible, the heat sink structures according to the prior art will not be applicable. Instead, heat sinks with special shapes should be designed, resulting in increases in costs and difficulty in modulization.

The present invention improves the heat sink structures according to the prior art. By combining multiple heat sink structures to form a nonlinear structure, flexible and free bending is possible and thus applicable to light-emitting structures with curved designs. The heat sink structure of a light-source device can dissipate the heat generated by LED light sources rapidly. In addition, the heat sink structures can adapt to the shape variation of lamp designs.

In the following description, various embodiments of the present invention are described using figures for describing the present invention in detail. Nonetheless, the concepts of the present invention can be embodied by various forms. Those embodiments are not used to limit the scope and range of the present invention.

Figure 1A:
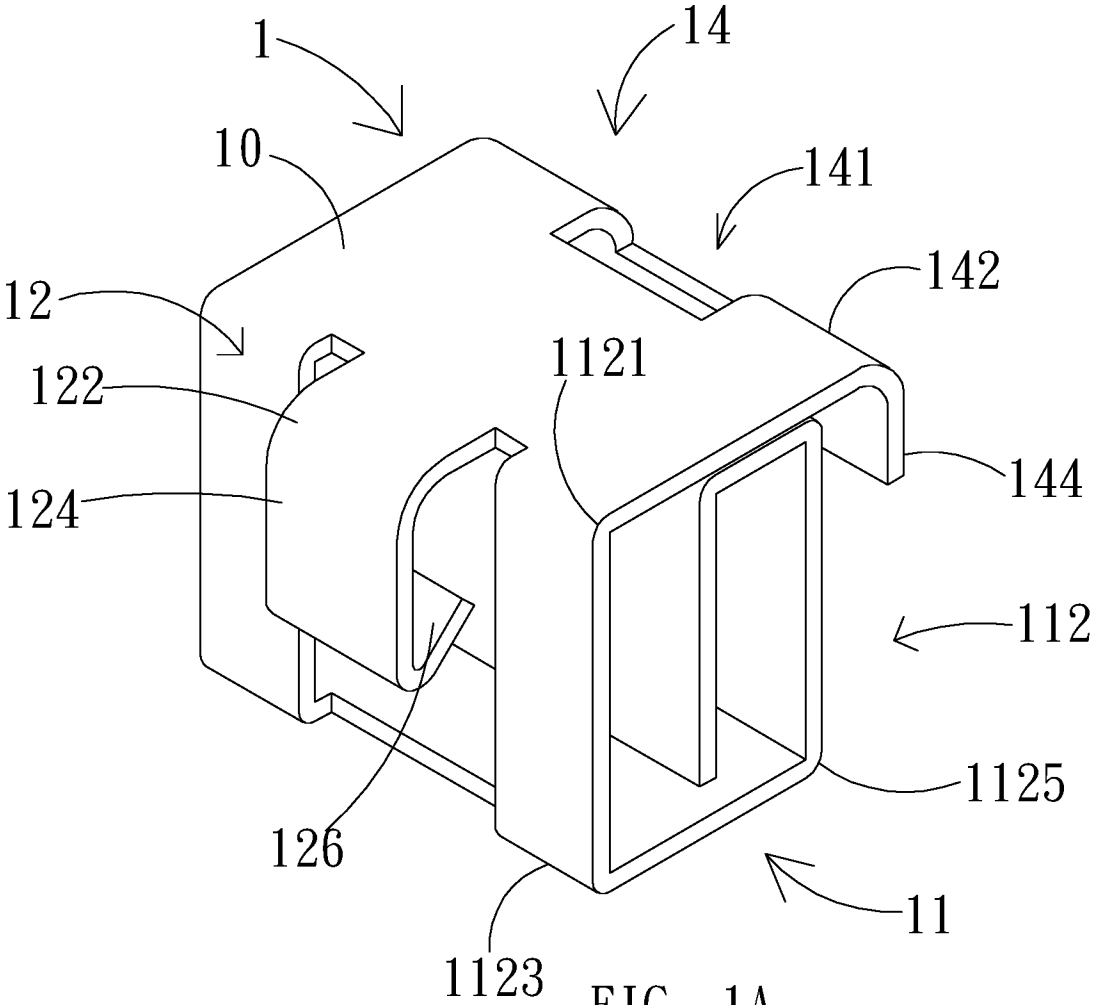
FIG. 1A shows a schematic diagram of the heat sink structure according to a first embodiment of the present invention.

First, please refer to FIG. 1A, which shows a schematic diagram of the heat sink structure according to a first embodiment of the present invention. As shown in the figure, a heat sink structure 1 according a first embodiment of the present invention comprises a body 10, a hooking part, 12, and a fixing part 14.

The hooking part 12 of the heat sink structure 1 includes a first bending part 122 connected to one end of the body 10. The other end of the first bending part 122 extends downwards to form one end of a first extending part 124. The other end of the first extending part 124 extends inwards and then upwards to form a hook 126. The fixing part 14 is disposed corresponding to the hooking part 12. The other end of the body 10 extends downwards to form one end of a second bending part 142 of the fixing part 14. The other end of the second bending part 142 extends downwards to form a second extending part 144. The second bending part 142 includes a hole 141 disposed corresponding to the width of the hooking part 12.

A heat sink part 11 is disposed below the body 10 of the heat sink structure 1. The heat sink part 11 includes an extension and bending mechanism 112. A first bending part 1121 of the extension and bending mechanism 112 extends downwards to a second bending part 1123. The second bending part 1123 extends horizontally to a third bending part 1125. The third bending part 1125 extends upwards.

Figure 1B:
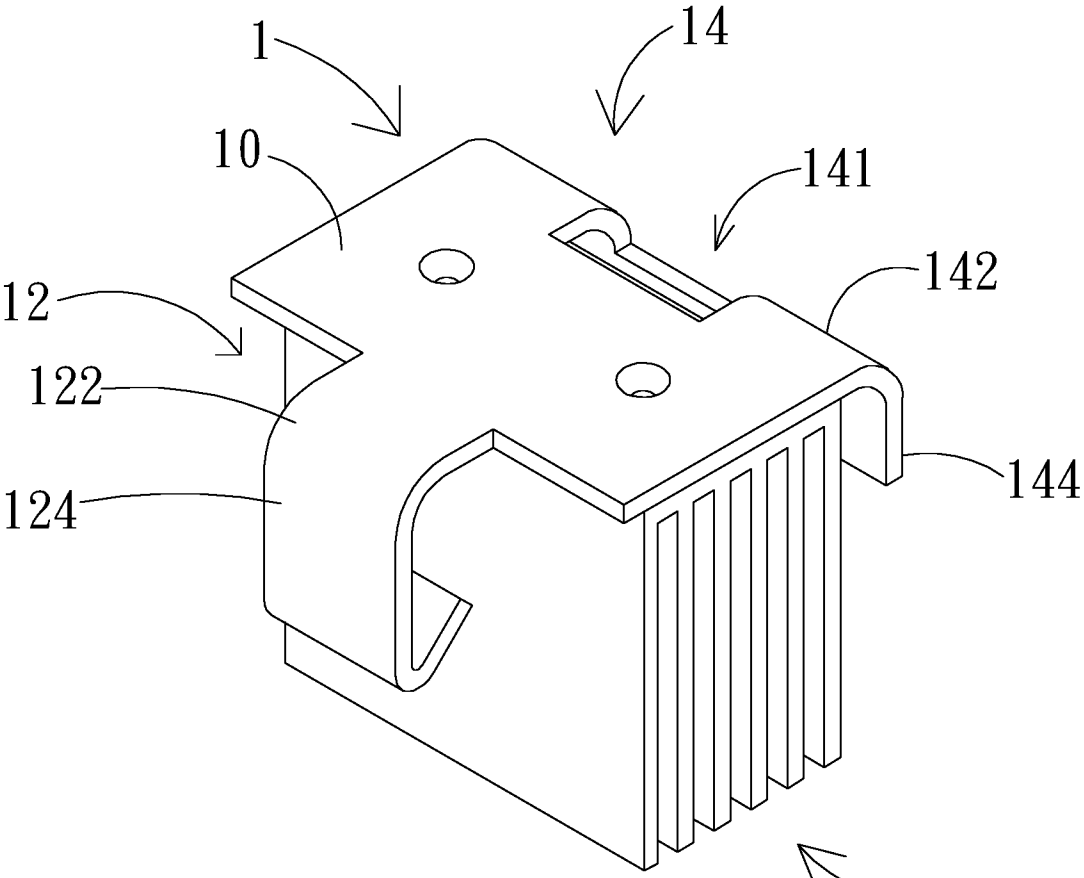
FIG. 1B shows a schematic diagram of the heat sink structure according to a second embodiment of the present invention.

Next, please refer to FIG. 1B, which shows a schematic diagram of the heat sink structure according to a second embodiment of the present invention. As shown in the figure, the heat sink part 11 below the body 10 of the heat sink structure 1 includes a plurality of fins 114. The plurality of fins 114 are the heat sink fins according to the prior art connected by screwing, soldering, or gluing. In addition, thermally conductive materials such as thermal paste can be applied between the heat sink part 11 of the plurality of fins 114 and the body 10 can improving heat dissipation rate. Furthermore, the plurality of fins 114 can be processed by aluminum extrusion, CNC, wire electrical discharge machining, or aluminum casting.

As described above, the heat sink structure 1 according to the present invention is different from the one-dimensional heat sink according to the prior art. Since thin metal plates can be cut and bent with ease, each single plate can be bent and holed to form a special chain mechanism with larger heat dissipating area larger than the heat sinks according to the prior art. In addition, no multiple processing assembling is required, and thus reducing processes and development costs. Besides, the heat sink structure 1 can be designed to match the width of light-emitting devices.

Figure 2:
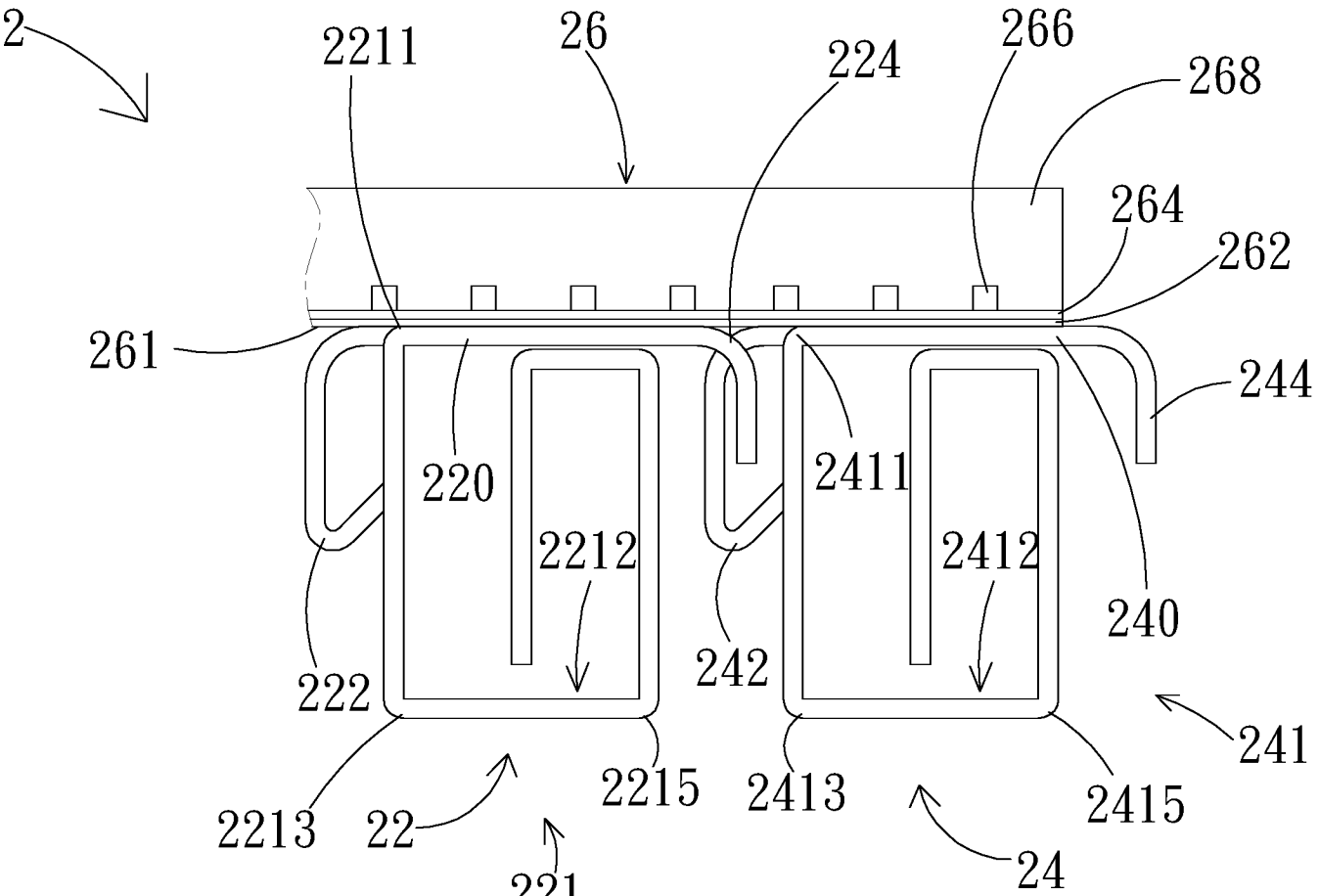
FIG. 2 shows a schematic diagram of the device structure according to a third embodiment of the present invention.
Figure 3:
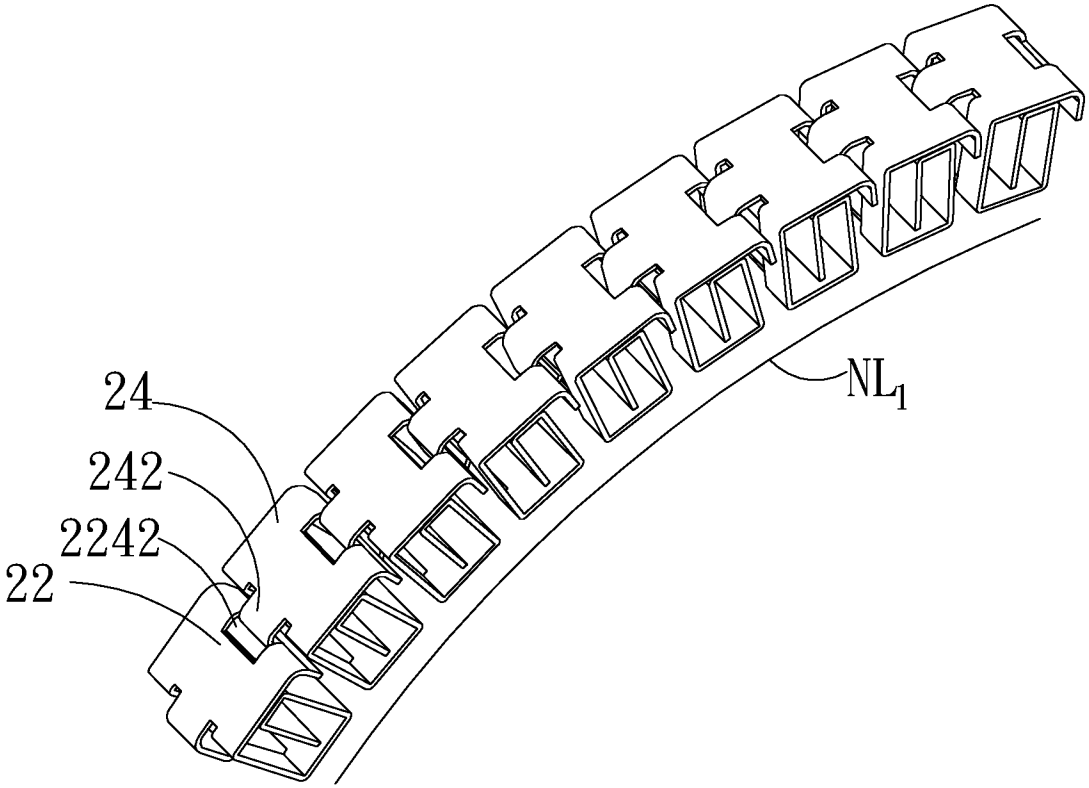
FIG. 3 shows a schematic diagram of the usage status A according to a third embodiment of the present invention.

Next, please refer to FIG. 2 and FIG. 3, which shows a schematic diagram of the device structure and the usage status A according to a third embodiment of the present invention. As shown in the figures, a flexible light-emitting device with heat sink structure 2 according to the third embodiment of the present invention comprises a first heat sink structure 22, a second heat sink structure 24, and a flexible light-emitting device 26.

The first heat sink structure 22 of the flexible light-emitting device with heat sink structure 2 comprises a first body 220, a first hooking part 222, and a first fixing part 224. A first heat sink part 221 is disposed below the first body 220. The first fixing part 224 is disposed corresponding to the first hooking part 222. The first fixing part 224 includes a first hole 2242. Furthermore, the first heat sink part 221 further includes a first extension and bending mechanism 2212. A first bending part 2211 of the first extension and bending mechanism 2212 extends downwards to a second bending part 2213. The second bending part 2213 extends horizontally to a third bending part 2215. The third bending part 2215 extends upwards.

The second heat sink structure 24 comprises a second body 240, a second hooking part 242, and a second fixing part 244. A second heat sink part 241 is disposed below the second body 240. The second fixing part 242 is disposed corresponding to the second hooking part 244. The second fixing part 244 includes a second hole 2442. The first hole 2242 is disposed corresponding to the width of the first hooking part 222; the second hole 2442 is disposed corresponding to the width of the second hooking part 242. The first hole 2242 is identical to the second hole 2442. The width of the first hooking part 222 is identical to the width of the second hooking part 242. The second hooking part 242 hooks into the first hole 2242 such that the first heat sink structure 22 hooks the second heat sink structure 24. The first heat sink structure 22 and the second heat sink structure 24 form a first nonlinear structure $NL_1$. Furthermore, the second heat sink part 241 further includes a second extension and bending mechanism 2412. A fourth bending part 2411 of the second extension and bending mechanism 2412 extends downwards to a fifth bending part 2413. The fifth bending part 2413 extends horizontally to a sixth bending part 2415. The sixth bending part 2415 extends upwards.

Moreover, the first heat sink part 221 and the second heat sink part 241 of the first heat sink structure 22 and the second heat sink structure 24 also includes a plurality of fins 114. Please refer to FIG. 1B. The plurality of fins 114 are the heat sink fins according to the prior art connected by screwing, soldering, or gluing. In addition, thermally conductive materials such as thermal paste can be applied between the heat sink part 11 of the plurality of fins 114 and the body 10 can improving heat dissipation rate. Furthermore, the plurality of fins 114 can be processed by aluminum extrusion, CNC, wire electrical discharge machining, or aluminum casting.

Besides, the flexible light-emitting device 26 dissipates heat through the plurality of fins 114.

The flexible light-emitting device 26 according to the third embodiment of the present invention is disposed on the first body 220 and the second body 240. The flexible light-emitting device 26 includes an insulation layer 262, a flexible printed circuit layer 264, one or more LED light source 266, and a flexible optical structure 268. The flexible printed circuit layer 264 is disposed on the insulation layer 262. The one or more LED light source 266 is disposed on the flexible printed circuit layer 264. The flexible optical structure 268 is disposed on the one or more LED light source 266. A fixing adhesive tape 261 disposed below the insulation layer 268 for fixing the flexible light-emitting device 26 on the first heat sink structure 22 and the second heat sink structure 24. The fixing adhesive tape 261 is selected from the group consisting of double-sided tape, thermally conductive interface material, and thermally conductive adhesive.

Next, an example will be provided. Please refer to FIG. 3, which shows a schematic diagram of the usage status A according to a third embodiment of the present invention. As shown in the figures, the first fixing part 224 of the first heat sink structure 22 and the second hooking part 242 of the second heat sink structure 24 can be connected freely. By connecting the first heat sink structure 22 and the second heat sink structure 24, a bending structure can be produced and forming the first nonlinear structure $NL_1$. Then the flexible light-emitting device 26 is disposed on the first nonlinear structure $NL_1$ such that the flexible light-emitting device 26 can be attached to the first heat sink structure 22 and the second heat sink structure 24 for dissipating heat. The heat generated by the LED light source 266 can be dissipated via the first heat sink part 221 and the second heat sink part 241 of the first heat sink structure 22 and the second heat sink structure 24. Thereby, the lifetime of the LED light source will not be shortened due to over temperature. Moreover, thanks to the bending structure between the first heat sink structure 22 and the second heat sink structure 24, the shape of the flexible light-emitting device 26 can be varied while maintaining heat dissipation performance.

According to the flexible light-emitting device with heat sink structure 2 according to the present invention, the first heat sink structure 22 and the second heat sink structure 24 are connected by hooking to form a flexible structure. No extra fixing member or connecting device is required. The first heat sink structure 22 and the second heat sink structure 24 are connected by hooking and forming the first nonlinear structure $NL_1$. The flexible light-emitting device 26 uses the formed first nonlinear structure $NL_1$ to dissipate heat. Furthermore, the flexible structure formed by the first heat sink structure 22 and the second heat sink structure 24 enables the shape of the flexible light-emitting device 26 be various. Even in a special shape, the heat dissipating performance is still excellent. In addition, thanks to the chain structure of the first heat sink structure 22 and the second heat sink structure 24, a modularized heat sink structure enables unlimited extension. The length can be adjusted according to the flexible light-emitting device 26. No extra process is required. Thereby, the design and fabrication of the heat sink structure can be reduced significantly.

Figure 4B:
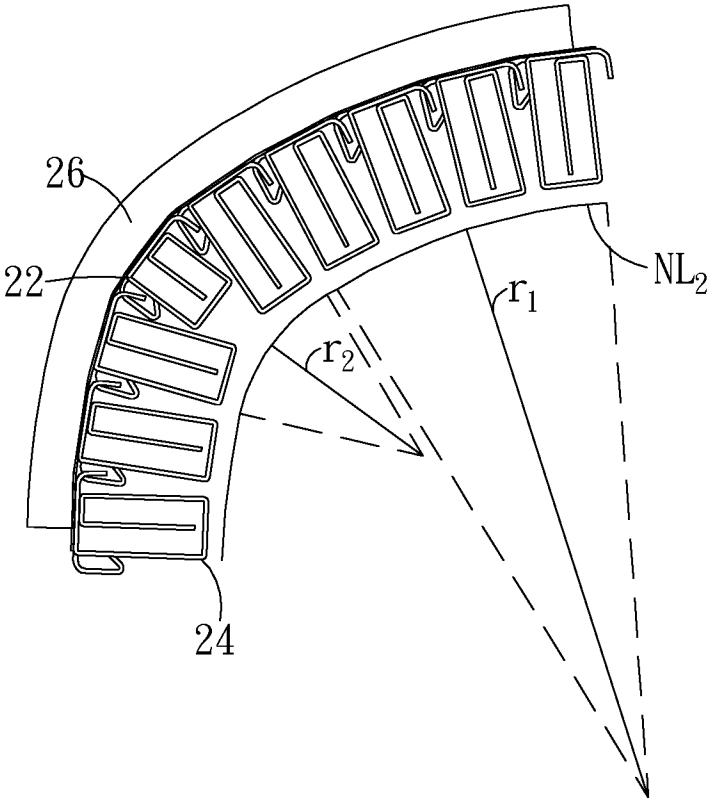
FIG. 4B shows a schematic diagram of the usage status of a first heat sink structure combining with a second heat sink structure according to a third embodiment of the present invention.
Figure 4A:
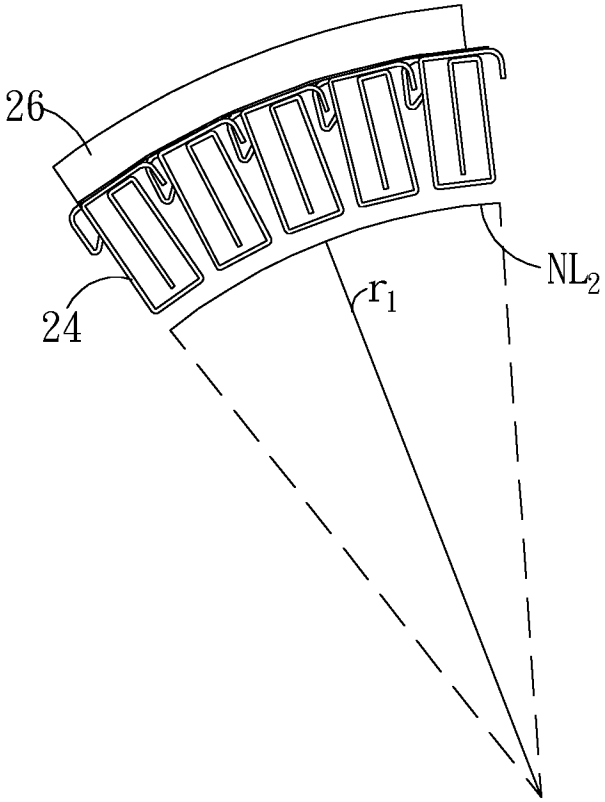
FIG. 4A shows a schematic diagram of the usage status of a plurality of the second heat sink structure connecting in series according to a third embodiment of the present invention.

Furthermore, if the height of the second heat sink structure 24 is greater than the height of the first heat sink structure 22, the combined structure will form a second nonlinear structure $NL_2$. If the second nonlinear structure $NL_2$ is formed purely by a plurality of the second heat sink structures 24, it will be the usage status of a plurality of the second heat sink structure connecting in series according to a third embodiment of the present invention, which shows in FIG. 4A. Since the height of the second heat sink structure 24 is increased as shown in the figure, a first curvature radius $r_1$ is increased. If the curvature radius is greater, the curvature will be smaller, and vice versa. Thereby, the first curvature radius $r_1$ will be increased by the increase in the height of the second heat sink structure 24, leading to decrease in the curvature of the heat sink structure. Next, please refer to FIG. 4B, which shows a schematic diagram of the usage status of a first heat sink structure combining with a second heat sink structure according to a third embodiment of the present invention. As shown in the figure, the second heat sink structure 24 combines with the first heat sink structure 22 to form the second nonlinear structure $NL_2$. Since a second curvature radius of the second nonlinear structure $NL_2$ is partially shortened, the heat sink structure will form a greater space for flexible adjustment.

According to the third embodiments A and B of the present invention, the first heat sink structure 22 and the second heat sink structure 24 can be connected to form the same structure (linear structure) as the rigid heat sinks according to the prior art and suitable for planar heat dissipation. Alternatively, the first heat sink structure 22 and the second heat sink structure 24 can form the first nonlinear structure $NL_1$ or the second nonlinear structure $NL_2$ to give flexible heat sink structures. The heat sink structure 1 according to the present invention can be applied to light-emitting devices with curved designs. Then the design of light-emitting device will no longer restricted by the rigid heat sink structure according to the prior art. More various shape designs are made possible. Moreover, the chain design can be easily extended or shortened according to light-emitting devices. No extra process is required.

Figure 5:
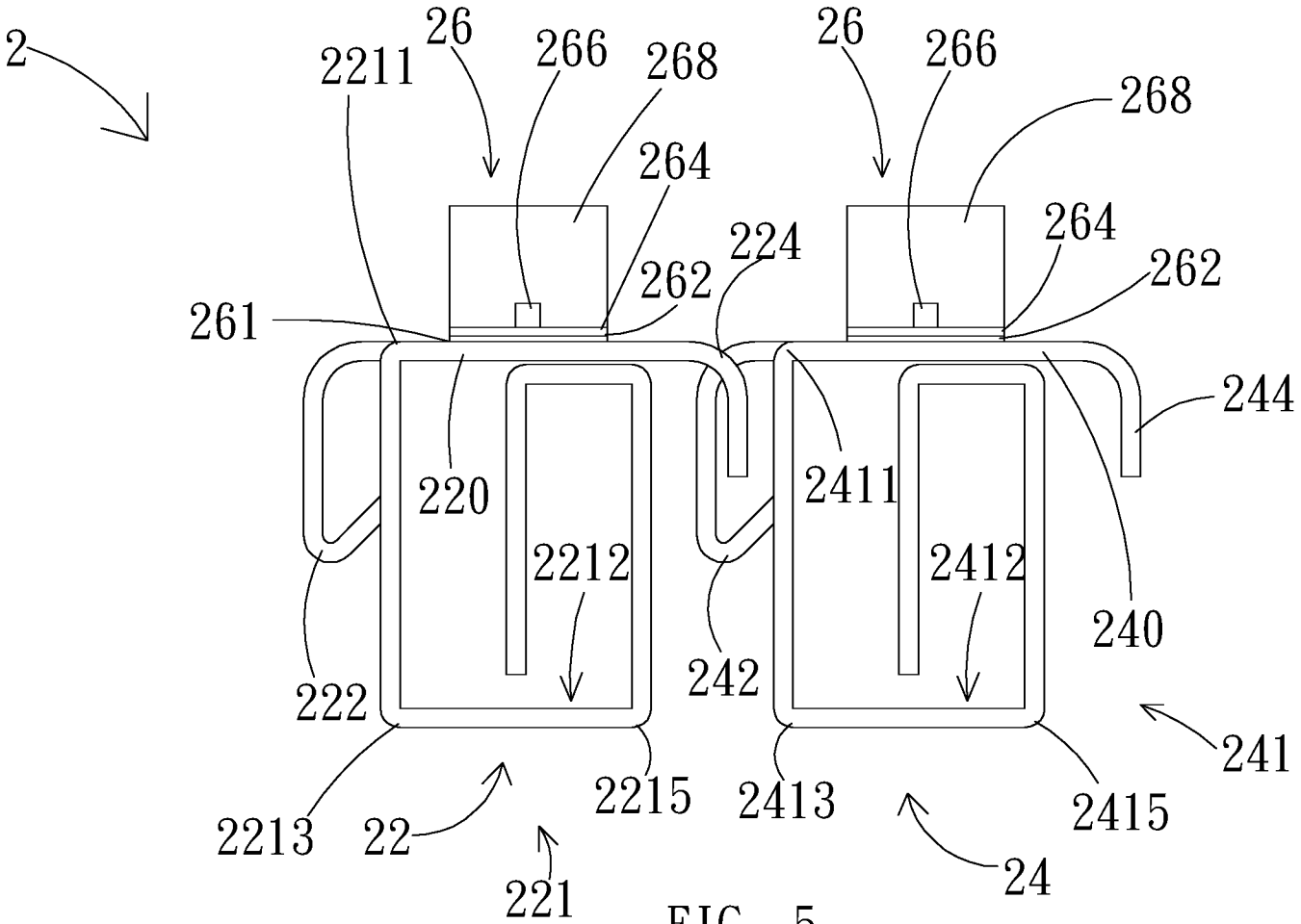
FIG. 5 shows a schematic diagram of the device structure according to a fourth embodiment of the present invention.

Next, please refer to FIG. 5, which shows a schematic diagram of the device structure according to a fourth embodiment of the present invention. As shown in the figures, a flexible light-emitting device with heat sink structure 2 according to the fourth embodiment of the present invention comprises a first heat sink structure 22, a second heat sink structure 24, and two flexible light-emitting devices 26. The first heat sink structure 22 and the second heat sink structure 24 according to the present embodiment are identical to the ones described in the previous embodiment according to the present invention. Hence, the details will not be described again.

Moreover, the first heat sink part 221 and the second heat sink part 241 of the first heat sink structure 22 and the second heat sink structure 24 also includes a plurality of fins 114. Please refer to FIG. 1B. The plurality of fins 114 are the heat sink fins according to the prior art connected by screwing, soldering, or gluing. In addition, thermally conductive materials such as thermal paste can be applied between the heat sink part 11 of the plurality of fins 114 and the body 10 can improving heat dissipation rate. Furthermore, the plurality of fins 114 can be processed by aluminum extrusion, CNC, wire electrical discharge machining, or aluminum casting. Besides, the flexible light-emitting device 26 dissipates heat through the plurality of fins 114.

The two flexible light-emitting devices 26 of the flexible light-emitting device with heat sink structure 2 according to the present invention include an insulation layer 262, a flexible printed circuit layer 264, an LED light source 266, and a flexible optical structure 268. The flexible printed circuit layer 264 is disposed on the insulation layer 262. The LED light source 266 is disposed on the flexible printed circuit layer 264. The flexible optical structure 268 is disposed on the LED light source 266. The fixing adhesive tape 261 fixes the flexible light-emitting devices 26 on the first heat sink structure 22 and the second heat sink structure 24. The fixing adhesive tape 261 is selected from the group consisting of double-sided tape, thermally conductive interface material, and thermally conductive adhesive.

As shown in FIG. 5, in the flexible light-emitting device with heat sink structure 2 according to the fourth embodiment of the present invention, the first heat sink structure 22 and the second heat sink structure 24 are connected by hooking to form a flexible structure. No extra fixing member or connecting device is required. The first heat sink structure 22 and the second heat sink structure 24 are connected by hooking and forming the first nonlinear structure NL1. The two flexible light-emitting devices 26 are disposed on the first heat sink structure 22 and the second heat sink structure 24, respectively, and uses the first heat sink structure 22 and the second heat sink structure 24 to dissipate heat. Besides, the electrical connection points of the flexible light-emitting device 26, such as the soldering portion and the component region, are protected to avoid breakage owing to the flexible bending of the first nonlinear structure $NL_1$. In addition, thanks to the chain structure of the first heat sink structure 22 and the second heat sink structure 24, a modularized heat sink structure enables unlimited extension. The length can be adjusted according to the flexible light-emitting devices 26. No extra process is required. Thereby, the design and fabrication of the heat sink structure can be reduced significantly.

According to the above embodiment, the present invention provides a heat sink structure and a flexible light-emitting device with heat sink structure. After multiple heat sink structures according to the present invention are connected repeatedly, the advantages include flexible shapes and rapid assembling. In addition, a single or several heat sink structures can form lamp shapes with curvature variation, not restricted by the shape of the heat sink structures according to the prior art. Thereby, the heat sink structure according to the present invention can adapt to lamp designs with various curves. Hence, the development costs can be reduced and various lamp designs can be improved.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

What is claimed is:

1. A heat sink structure, comprising:

a body, having a heat sink part disposed below;

a hooking part, including a first bending part connected to one end of said body, the other end of said first bending part extending downwards to form one end of a first extending part, and the other end of said first extending part extending inwards and then upwards to form a hook;

a fixing part, disposed corresponding to said hooking part, including a second bending part, one end of said second bending part of said fixing part formed by extending the other end of said body downward, the other end of said second bending part extending downwards to form a second extending part, and said second bending part including a hole;

wherein said heat sink part further includes an extension and bending mechanism having a first bending part, a second bending part and a third bending part; said first bending part of said extension and bending mechanism is extended downwards to said second bending part of said extension and bending mechanism; said second bending part of said extension and bending mechanism is extended horizontally to said third bending part of said extension and bending mechanism; and said third bending part of said extension and bending mechanism extends upwards and against said body.

2. The heat sink structure of claim 1, wherein said heat sink part includes a plurality of fins.

3. The heat sink structure of claim 1, wherein a width of said hole is corresponding to a width of said hooking part.

4. A flexible light-emitting device with heat sink structures, comprising:

a first heat sink structure, including a first body, a first hooking part, and a first fixing part, a first heat sink part disposed below said first body, said first fixing part disposed corresponding to said first hooking part, and said first fixing part including a first hole;

a second heat sink structure, including a second body, a second hooking part, and a second fixing part, a second heat sink part disposed below said second body, said second fixing part disposed corresponding to said second hooking part, said second fixing part including a second hole, said second hooking part hooking into said first hole such that said first heat sink structure hooking said second heat sink structure, and said first heat sink structure connected with said second heat sink structure to form a first nonlinear structure; and a flexible light-emitting device, disposed on said first body and said second body;

wherein the height of said second heat sink structure is greater than the height of said first heat sink structure.

5. The flexible light-emitting device with heat sink structures of claim 4, wherein a width of said first hole is corresponding to a width of said first hooking part; and a width of said second hole is corresponding to a width of said second hooking part.

6. The flexible light-emitting device with heat sink structures of claim 1, wherein said first heat sink structure and a plurality of said second heat sink structure form a second nonlinear structure while the height of said second heat sink structure is greater than the height of said first heat sink structure.

7. The flexible light-emitting device with heat sink structures of claim 4, wherein said flexible light-emitting device includes:

an insulation layer;

a flexible printed circuit layer, disposed on said insulation layer;

one or more LED light source, disposed on said flexible printed circuit layer; and a flexible optical structure, disposed on said one or more LED light source.

8. The flexible light-emitting device with heat sink structures of claim 7, and further comprising a fixing adhesive tape disposed below said insulation layer.

9. The flexible light-emitting device with heat sink structures of claim 4, where said first heat sink part further including a first extension and bending mechanism; a first bending part of said first extension and bending mechanism extends downwards to a second bending part; said second bending part extends horizontally to a third bending part; and said third bending part extends upwards.

10. The flexible light-emitting device with heat sink structures of claim 4, where said second heat sink part further includes a second extension and bending mechanism; a fourth bending part of said second extension and bending mechanism extends downwards to a fifth bending part; said fifth bending part extends horizontally to a sixth bending part; and said sixth bending part extends upwards.

11. The heat sink structure of claim 4, wherein said first heat sink part and said second heat sink part include a plurality of fins.

12. A flexible light-emitting device with heat sink structures, comprising:

a first heat sink structure, including a first body, a first hooking part, and a first fixing part, a first heat sink part disposed below said first body, said first fixing part disposed corresponding to said first hooking part, and said first fixing part including a first hole disposed corresponding to said first hooking part;

a second heat sink structure, including a second body, a second hooking part, and a second fixing part, a second heat sink part disposed below said second body, said second fixing part disposed corresponding to said second hooking part, said second fixing part including a second hole, said second hooking part hooking into said first hole such that said first heat sink structure hooking said second heat sink structure, and said first heat sink structure and said second heat sink structure forming a first nonlinear structure; and two flexible light-emitting devices, disposed on said first body and said second body, respectively;

wherein the height of said second heat sink structure is greater than the height of said first heat sink structure.

13. The flexible light-emitting device with heat sink structures of claim 12, wherein a width of said first hole is corresponding to a width of said first hooking part; and a width of said second hole is corresponding to a width of said second hooking part.

14. The flexible light-emitting device with heat sink structures of claim 12, wherein said first heat sink structure and a plurality of said second heat sink structure form a second nonlinear structure while the height of said second heat sink structure is greater than the height of said first heat sink structure.

15. The flexible light-emitting device with heat sink structures of claim 12, wherein said two flexible light-emitting devices comprising:

an insulation layer;

a flexible printed circuit layer, disposed on said insulation layer;

an LED light source, disposed on said flexible printed circuit layer; and a flexible optical structure, disposed on said LED light source.

16. The flexible light-emitting device with heat sink structure of claim 15, further comprising a fixing adhesive tape disposed below said insulation layer.

17. The flexible light-emitting device with heat sink structures of claim 12, where said first heat sink part further including a first extension and bending mechanism; a first bending part of said first extension and bending mechanism extends downwards to a second bending part; said second bending part extends horizontally to a third bending part; and said third bending part extends upwards.

18. The flexible light-emitting device with heat sink structures of claim 12, where said second heat sink part further includes a second extension and bending mechanism; a fourth bending part of said second extension and bending mechanism extends downwards to a fifth bending part; said fifth bending part extends horizontally to a sixth bending part; and said sixth bending part extends upwards.

19. The flexible light-emitting device with heat sink structures of claim 12, wherein said first heat sink part and said second heat sink part include a plurality of fins.

* * * * *